US011606975B2

(12) United States Patent
Batista

(10) Patent No.: US 11,606,975 B2
(45) Date of Patent: Mar. 21, 2023

(54) CARTRIDGE FOR AEROSOL-GENERATING SYSTEM

(71) Applicant: Philip Morris Products S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 70 days.

(21) Appl. No.: 17/398,681

(22) Filed: Aug. 10, 2021

(65) Prior Publication Data

US 2021/0360972 A1 Nov. 25, 2021

Related U.S. Application Data

(62) Division of application No. 15/577,957, filed as application No. PCT/EP2016/062945 on Jun. 8, 2016, now Pat. No. 11,140,919.

(30) Foreign Application Priority Data

Jun. 12, 2015 (EP) ..... 15171951

(51) Int. Cl.
*A24F 40/44* (2020.01)
*A24F 40/46* (2020.01)
(Continued)

(52) U.S. Cl.
CPC ..... *A24F 40/44* (2020.01); *A24F 40/46* (2020.01); *H05B 3/82* (2013.01); *A24F 40/10* (2020.01)

(58) Field of Classification Search
CPC ..... A24F 40/46; A24F 40/44; A24F 40/10
See application file for complete search history.

(56) References Cited

U.S. PATENT DOCUMENTS

2009/0272379 A1* 11/2009 Thorens ..... A24F 40/46 219/535
2013/0213419 A1 8/2013 Tucker
(Continued)

FOREIGN PATENT DOCUMENTS

CN 104397875 A 3/2015
EA 013046 B1 2/2010
(Continued)

OTHER PUBLICATIONS

International Search Report and Written Opinion dated Sep. 8, 2016 in PCT/EP2016/062945, filed Jun. 8, 2016.
(Continued)

*Primary Examiner* — Alex B Efta
(74) *Attorney, Agent, or Firm* — Oblon, McClelland, Maier & Neustadt, L.L.P.

(57) ABSTRACT

An aerosol-generating system is provided, including a main unit including a power supply; and a cartridge removably mounted to the main unit and including: a liquid storage portion to store a liquid, a heater assembly including a flat-shaped fluid-permeable heating element, including first and second surfaces, the first surface arranged in an upstream position to receive a liquid, and the second surface arranged in a downstream position to release the liquid in vaporized form, and a capillary body having a first elongated end and a second end, the first elongated end extending into the storage portion to contact the liquid, the second end contacting the first surface of the heating element, a cross-sectional area of the capillary body at the second end is greater than that at the first elongated end, the capillary body including capillary fibers at the first elongated end and at the second end.

4 Claims, 5 Drawing Sheets

(51) Int. Cl.
*A24F 40/10* (2020.01)
*H05B 3/82* (2006.01)

(56) References Cited

U.S. PATENT DOCUMENTS

| | | | | |
|---|---|---|---|---|
| 2013/0319407 | A1* | 12/2013 | Liu | A24F 40/485 128/202.21 |
| 2014/0261493 | A1* | 9/2014 | Smith | A24F 40/40 131/328 |
| 2014/0283859 | A1 | 9/2014 | Minskoff et al. | |
| 2014/0345633 | A1 | 11/2014 | Talon et al. | |
| 2015/0068541 | A1 | 3/2015 | Sears | |
| 2015/0136156 | A1 | 5/2015 | Liu | |
| 2016/0120222 | A1 | 5/2016 | Bagai et al. | |
| 2016/0213066 | A1 | 7/2016 | Zitzke et al. | |
| 2017/0027233 | A1 | 2/2017 | Mironov | |

FOREIGN PATENT DOCUMENTS

| | | | |
|---|---|---|---|
| EP | 2 810 570 | A1 | 12/2014 |
| EP | 2 856 893 | A1 | 4/2015 |
| JP | 2015-507477 | A | 3/2015 |
| WO | 2007/042941 | A1 | 4/2007 |
| WO | 2013/098398 | A2 | 7/2013 |
| WO | 2013/181796 | A1 | 12/2013 |
| WO | 2015/071682 | A1 | 5/2015 |

OTHER PUBLICATIONS

Combined Office Action and Search Report dated Aug. 20, 2019 in Russian Patent Application No. 2017135249, 11 pages (with English translation).

Japanese Office Action dated Jun. 15, 2020 in Japanese Patent Application No. 2017-564093 (with English translation), 10 pages.

Chinese Office Action dated Aug. 19, 2020 in corresponding Chinese Patent Application No. 201680029805.6 (with English translation), 18 pages.

U.S. Appl. No. 15/577,957, filed Nov. 29, 2018, 2018/0132532 A1, Rui Nuno Batista.

* cited by examiner

CARTRIDGE FOR AEROSOL-GENERATING SYSTEM

CROSS-REFERENCE TO RELATED APPLICATIONS

This application is a divisional of and claims benefit under 35 U.S.C. § 120 to U.S. application Ser. No. 15/577,957, filed Nov. 29, 2017, which is a U.S. national stage application of International Application No. PCT/EP2016/062945, filed Jun. 8, 2016, which claims the benefit of priority under 35 U.S.C. § 119 to European Application No. 15171951.5, filed Jun. 12, 2015, each of these documents being incorporated herein by reference in their entireties.

The present invention relates to a cartridge for an aerosol-generating system. The cartridge is in particular useful for e-cigarettes products having a liquid storage portion and a heating element which vaporizes the liquid.

An example of aerosol-generating system is an electrically operated smoking system. One type of handheld electrically operated smoking systems consists of a first portion comprising a battery and control electronics, and a cartridge portion comprising a supply of aerosol-forming substrate, and an electrically operated vaporizer. The cartridge portion typically comprises not only the supply of aerosol-forming substrate and an electrically operated vaporizer, but also a mouthpiece, which the user sucks on in use to draw aerosol into their mouth. Heat, ultrasonic energy, or other means are normally used in order to vaporize or atomize a liquid solution into an aerosol mist.

In some embodiments, vaporising is achieved by applying electrical current to an assembly comprising a wick and a heating element. The wick is usually in communication with a liquid reservoir, i.e. one end of it extends into a liquid storage portion for contact with the liquid. The heating element usually completely or partially encircles the other end of the wick. Commonly, the liquid is transported to the heating element by the use of capillary force or capillary action. Wicks as described above are often cylinder-shaped, i.e. they have a cross sectional area which is more or less constant over the whole length of the wick.

The heating element often comprises a coil of wire surrounding one end of the capillary wick. In this case the wire is mostly a metal wire or a metal alloy wire. The heating element usually heats the liquid at this end of the capillary wick by means of conduction. The heating element is at least partially in contact with this end of the wick.

In such cases the temperature of the outer portion of the wick which is in direct contact with the coil might be higher than the temperature of the inside portion of the wick. This may result in a non-uniform heat distribution across the cross section of the wick which could make it difficult to control the optimum temperature for the heating element. This may also affect the capillary action of the wick which is related to the heat transmitted to the capillary fibers. A non-uniform heat distribution could result in an unevenly distributed capillary action of the wick and to a lower capillary efficiency of the inner part of the wick.

It would be desirable to have a cartridge which allows to evenly heat a capillary body, e.g. a wick, giving a much better control on the wick capillary action through current sent into the heating element, as well as on the efficiency of the liquid vaporization relatively to the electrical power used.

The cartridge for use in an electrically operated aerosol-generating system, comprises a liquid storage portion to store a liquid, a fluid permeable heating element, and a capillary body. The fluid permeable heating element comprises a first and a second surface wherein the first surface is arranged in an upstream position to receive the liquid from the liquid storage portion and the second surface is arranged in a downstream position to release the liquid in vaporized form. The capillary body has a first elongated end and a second end, wherein the first elongated end extends into the liquid storage portion for contact with the liquid and the second end contacts the first surface of the heating element. The capillary body is characterized in that the cross sectional area at the second end is greater than the cross sectional area at the elongated first end.

The cartridge may comprise a housing containing the liquid storage portion and the heating element. The heating element may be fixed to the housing of the liquid storage portion. The housing may be a rigid housing and impermeable to fluid. As used herein "rigid housing" means a housing that is self-supporting. The rigid housing of the liquid storage portion preferably provides mechanical support to the cartridge.

The liquid storage portion has a length and a width dimension and an opening at one end in the longitudinal direction. The liquid storage portion forms a reservoir comprising a liquid used as aerosol-forming substrate. The opening extends across at least a part of the width of the liquid storage portion. In a preferred embodiment the heating element extends across the opening of the liquid storage portion. This allows for leak-proof sealing of the liquid storage portion in order to avoid leakage of the liquid from the liquid storage portion into the environment and provides a robust construction that is relatively simple to manufacture. The liquid storage portion may be sealed by a membrane which may be ruptured during assembly in order to provide liquid contact between the capillary body and the liquid.

The liquid storage portion comprises a capillary body configured to convey liquid aerosol-forming substrate to the heater element. The capillary body has a first elongated end which extends into the liquid storage portion for contact with the liquid. The second end of the capillary body is in contact with the first surface of the heating element.

Preferably, the elongated first end of the capillary body is arranged to be in a direction parallel to the length direction of the liquid storage portion. The plane of the heating element may be in a direction perpendicular to the elongated first end of the capillary body. In an alternative embodiment the plane of the heating element may be in a direction parallel to the elongated first end of the capillary body.

The heating element can have any suitable shape. For example, the heating element may be, flat-shaped. The term "flat-shaped" is used to refer to a shape that extends substantially in a single plane. A flat-shaped heating element is preferred since it can be easily handled during manufacture and provides for a robust construction. The heating element may have a round, oval, square, triangular, rectangular or polyangular shape, preferably a square or a rectangular shape. In other embodiments, the heating element may be curved along one or more dimensions, for example forming a dome shape or bridge shape.

The heating element may be formed from a plurality of electrically conductive filaments, which may form a mesh or array of filaments or may comprise a woven or non-woven fabric. The heater element is fluid permeable. As used herein "fluid permeable" in relation to a heater element means that the liquid or aerosol-forming substrate, in a gaseous phase and possibly in a liquid phase, can readily pass through the heater assembly or heater element.

The term "filament" is used preferably to refer to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner.

The term "filament arrangement" is used preferably to refer to an arrangement of one or preferably a plurality of filaments. The filament arrangement may be an array of filaments, for example arranged parallel to each other. Preferably, the filaments may form a mesh or a woven or non-woven.

The heater element may have electrically conductive contact portions which are configured to allow contact with an external power supply on a second face of the heater element opposite to the first face.

The electrically conductive filaments may comprise any suitable electrically conductive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The filaments may be coated with one or more insulators. Preferred materials for the electrically conductive filaments are 304, 316, 304L, and 316L stainless steel, and graphite.

The capillary body may be in contact with electrically conductive filaments of the heating element. The material of the capillary body may extend into interstices between the filaments. The heating element may draw liquid aerosol-forming substrate into the interstices by capillary action. The capillary material may cover at least 50%, preferably at least 70%, more preferably at least 90%, most preferably substantially 100% of the first surface of the heating element.

The cross sectional area of the capillary body at the first end is greater than the cross sectional area of the capillary body at the second end. Thus, the cross sectional area of the capillary body increases from the end extending into the liquid storage portion for contact with the liquid towards the second end of the capillary body contacting the heating element. In a preferred embodiment the cross sectional area the cross sectional area of the capillary body at the second end is greater than the cross sectional area of the capillary body at the first elongated end by a factor of 1.1 to 20, preferably a factor of 2 to 15, more preferably a factor of 3 to 10.

Preferably, the first and the second ends of the capillary body have a round, oval, square, triangular, rectangular or polyangular shape, preferably round or oval shape. For example, the capillary body may have the shape of a tapering cylinder or rod or the shape of a funnel. It is also possible that the first elongated end of the capillary body has a round shape and the second end of the capillary body is adapted to fit the shape of the heating element.

The capillary body may comprise a majority of capillary fibers. Preferably, the capillary fibers at the first end of the capillary body are in a direction which is perpendicular to the plane of the heating element, and at the second end of the capillary body in a direction which is parallel to the plane of the heating element. Preferably, the heating element comprises a plurality of electrically conductive filaments and a part of the capillary fibers at the second end of the capillary body is aligned with the electrically conductive filaments of the substantially heating element.

The capillary body may have a fibrous or spongy structure. For example, the capillary body may be a capillary wick comprising a plurality of fibres or threads, generally aligned in a longitudinal direction. Alternatively, the capillary body may be a sponge-like material. The structure of the capillary body forms a plurality of small bores or tubes, through which the liquid can be transported from the liquid storage portion to the heating element, by capillary action. The capillary body may comprise any suitable material or combination of materials. Examples of suitable materials are ceramic- or graphite-based materials in the form of fibres or sintered powders. The capillary body may have any suitable capillarity and porosity so as to be used with different liquid physical properties such as density, viscosity, surface tension and vapour pressure. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary device by capillary action.

The capillary body may be a rigid tubular body having a single bore, through which the liquid can be transported from the liquid storage portion to the heating element, by capillary action. The rigid tubular body may be funnel-shaped or shaped like a trumpet.

The capillary body may have the structure of a rigid tubular body having a bore, configured to receive a majority of capillary fibers or sponge-like capillary material. The rigid tubular body forms a sheath or shell for the capillary fibers or sponge-like capillary material.

The provision of a cartridge of this type in an aerosol-generating system has several advantages over a conventional wick and coil arrangement. A cartridge comprising the heating element and capillary body as described above allows for a greater area of the capillary body to be in contact with the heating element thereby increasing the contact are in which a liquid is vaporised. The cartridge can be inexpensively produced, using readily available materials and using mass production techniques. The cartridge is robust allowing it to be handled and fixed to other parts of the aerosol-generating system during manufacture, and in particular to form a removable cartridge. The provision of electrically conductive contact portions forming part of the heater element allows for reliable and simple connection of the heater assembly to a power supply.

There is also provided a method of manufacture of a cartridge for use in an aerosol-generating system, comprising:

providing a liquid storage portion comprising a housing having an opening;

filling the liquid storage portion with liquid aerosol-forming substrate;

providing a heater assembly comprising at least one fluid permeable heating element extending across the opening of the housing, providing a capillary body wherein the cross sectional area of the capillary body at a second end is greater than the cross sectional area of the capillary body at a first elongated end, and contacting the second end of capillary body with at least one surface of the heating element.

The step of filling the liquid storage portion may be performed before or after the step of fixing the heater assembly to the liquid storage portion.

The step of contacting may, for example, comprise heat sealing, gluing or welding the heating element to the liquid storage portion. The liquid storage portion may contain a majority of capillary fibers. In a preferred embodiment the capillary body is a wick comprising a majority of capillary fibers which are fanned out at a second end thereby achieving a capillary body wherein the cross sectional area of the capillary body at that second end is greater than the cross sectional area of the capillary body at a first elongated end.

There is also provided an aerosol-generating system comprising a main unit and the cartridge of the present invention, wherein the liquid storage portion and heater assembly are provided in the cartridge and the main unit comprises a power supply. Preferably the cartridge is removably mounted to the main unit. In a preferred embedment the aerosol-generating system comprises an elongated body, wherein the fluid permeable heating element is arranged transverse to the elongated body. More preferably the aerosol-generating system further comprising electric circuitry connected to the heater assembly and to an electrical power source, the electric circuitry configured to monitor the electrical resistance of the heater assembly or of one or more filaments of the heater assembly, and to control a supply of power from the electrical power source to the heater assembly dependent on the electrical resistance of the heater assembly or the one or more filaments. In a preferred embodiment the aerosol-generating system comprising a cartridge according to the present invention is an electrically operated smoking system.

The invention will be further described, by way of example only, with reference to the accompanying drawings in which.

Figure 1:
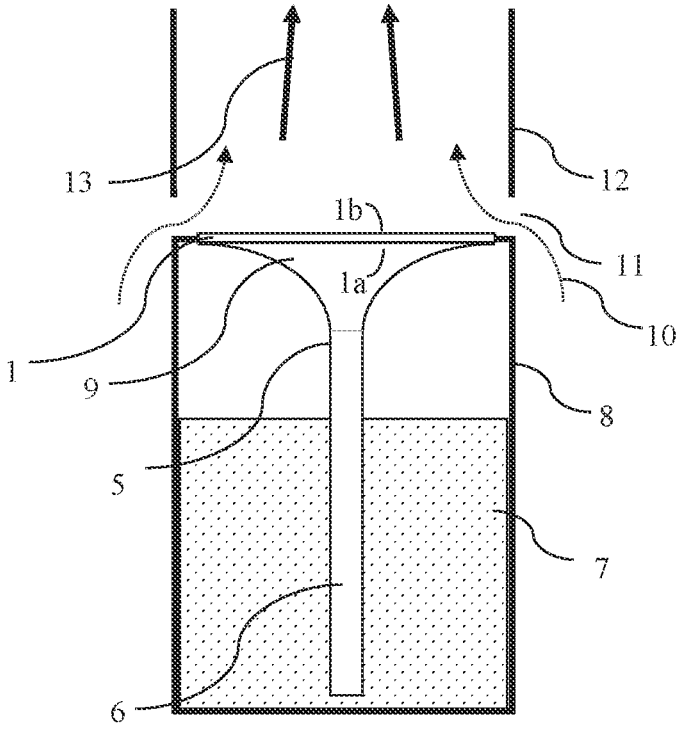
FIG. 1 shows a cross-sectional view of the cartridge of the present invention as part of an aerosol-generating system.

FIG. 1 shows in side view, an aerosol-generating system according to one embodiment of the invention. The aerosol-generating system comprises a liquid storage portion (8) containing a liquid (7), a flat-shaped heating element (1) and a capillary body (5). The heating element (1) comprises a first (1*a*) and a second (1*b*) surface wherein the first surface (1*a*) is arranged in an upstream position to receive the liquid (7) and the second surface (1*b*) is arranged in a downstream position to release the liquid (7) in vaporized form. In FIG. 1 the capillary body (5) has a first elongated end (6) at the bottom which is dipped into the liquid (7). The second end (9) of the capillary body (5) is spread out in contact with at the first surface (1*a*) of the heating element (1). When a user draws air via a mouthpiece (not shown), the outside air (10) is drawn into the e-cigarette via air inlets (11) provided near the heating element of the e-cigarette. The air arrives at a part (12) near the heating element where it combines with the vaporized e-liquid (13) and is subsequently guided to the mouthpiece.

Figure 2:
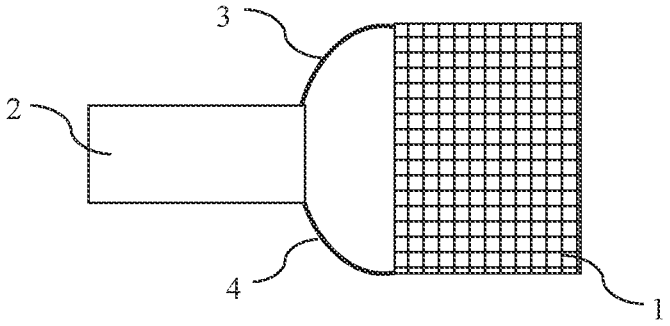
FIG. 2 shows a plan view of a heating element in the form of a rectangular flat mesh.

FIG. 2 shows an embodiment of the heating element (1), which is in the form of a flat rectangular mesh comprising a plurality of electrically conductive filaments. The heating element is electrically connected to a battery (2) via wires (3) and (4) at opposing end.

Figure 3:
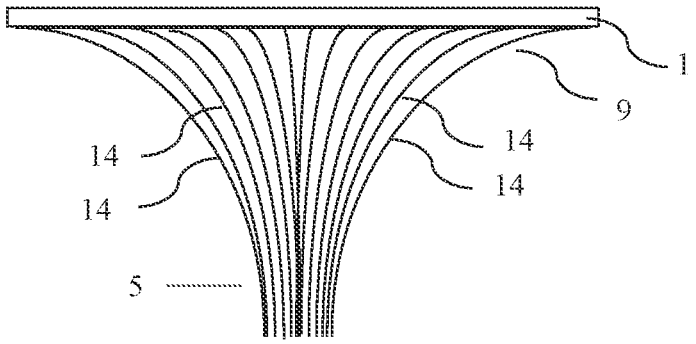
FIG. 3 shows a close-up cross-sectional view of capillary body and heating element according to an embodiment of the invention.

FIG. 3 shows a close-up of an arrangement of the heater element (1) and a funnel-shaped capillary body according to one embodiment of the invention. It shows the heating element (1) and the top part (9) of the capillary body, comprising a plurality of capillary fibers (14). In this embodiment the capillary fibers (14) at the second end (9) of the capillary body (5) are bent or curved in a direction which is parallel to the plane of the flat heating element (1), thereby maximizing the surface of capillary fibers in direct contact with the heating element (1).

Figure 4:
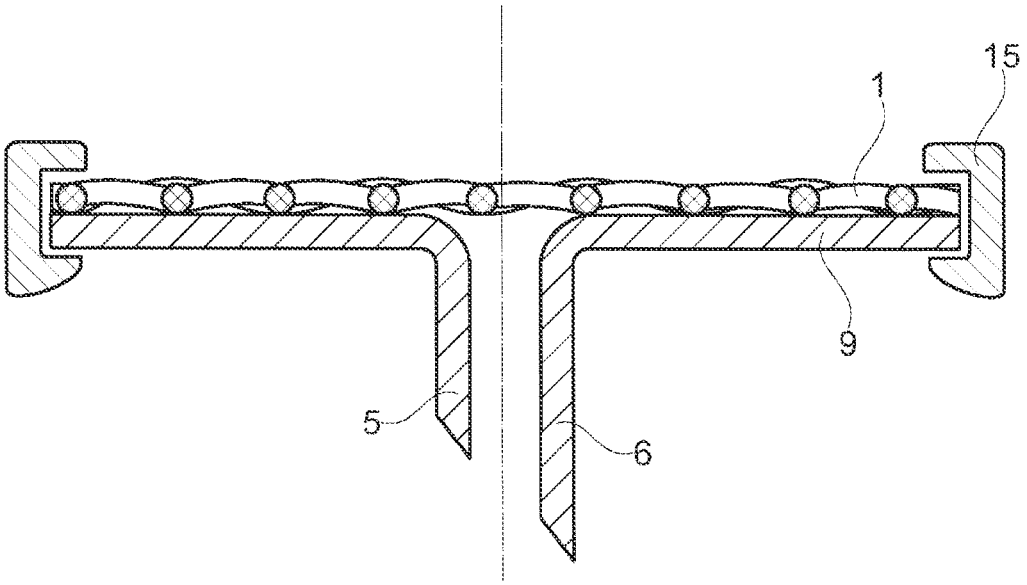
FIG. 4 is an enlarged cross-sectional view of the linkage between a heating element and a capillary body according to a further embodiment of the present invention.

FIG. 4 is an enlarged cross-sectional view of the connection between a capillary body (5) and a substantially flat-shaped heating element (1) according to one embodiment of the invention. In this embodiment the capillary body (5) is funnel-shaped and the second end (9) of the capillary body (5) is bent outwards in a direction which is parallel to the plane of the flat heating element (1). The capillary body (5) has a bore and its first elongated end (6) is bevelled. The heating element (1) and the second end (9) of the capillary body (5) are held together by an annular sealing member (15).

Figure 5:
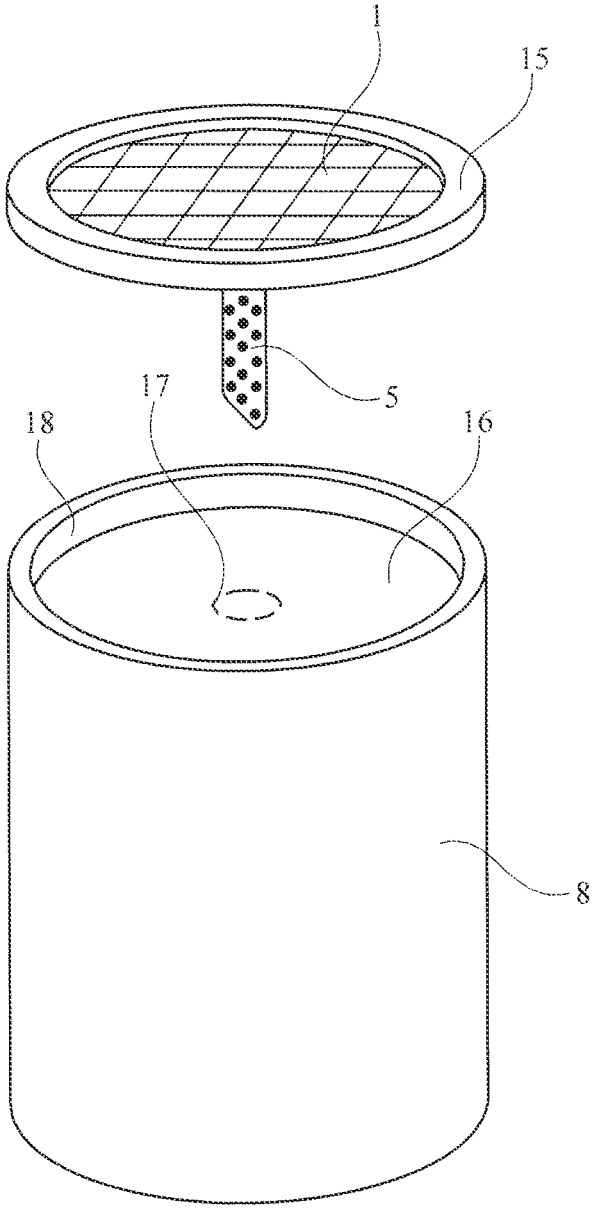
FIG. 5 shows an exploded view of a cartridge according to a further embodiment of the present invention.

FIG. 5 is an exploded view of the cartridge according to one embodiment of the present invention. The liquid storage portion (8) to store the liquid (not shown) is cylindrical-shaped. The liquid in the liquid storage portion (8) is sealed by a membrane (16) prior assembly. In FIG. 5 the upper part shows the funnel-shaped capillary body (5) of FIG. 4 with a bevelled lower end. The capillary body (5) is linked to a flat heating element (1) by the annular sealing member (15). During assembly of the cartridge, membrane (16) is penetrated by the bevelled lower end of the funnel-shaped capillary body (5) thereby creating a hole (17). In use the bevelled lower end of the capillary body (5) extends through the hole (17) into the liquid in the liquid storage portion (8) and allows the liquid being transported through a bore of the funnel-shaped capillary body (5) to the heating element (1) by the use of capillary force. The annular sealing member (15) is configured to fit in the rim (18) of the cylindrical-shaped liquid storage portion (8) and establishes a substantially leak-tight connection between the liquid storage portion (8) and the connected capillary body (5) and heating element (1).

The invention claimed is:

1. An aerosol-generating system, comprising a main unit comprising a power supply; and a cartridge comprising a liquid storage portion configured to store a liquid, a heater assembly comprising a flat-shaped fluid-permeable heating element, comprising a first surface and a second surface, the first surface being arranged in an upstream position configured to receive a liquid, and the second surface being arranged in a downstream position configured to release the liquid in vaporized form, and a capillary body having a first elongated end and a second end, the first elongated end extending into the liquid storage portion configured to contact the liquid, the second end contacting the first surface of the heating element, wherein a cross-sectional area of the capillary body at the second end is greater than a cross-sectional area of the capillary body at the first elongated end, wherein the capillary body comprises capillary fibers at the first elongated end of the capillary body in a direction perpendicular to a plane of the flat-shaped fluid-permeable heating element, and at the second end of the capillary body in a direction parallel to the plane of the flat-shaped fluid-permeable heating element, and wherein the flat-shaped fluid-permeable heating element further comprises a plurality of electrically conductive filaments and a part of the capillary fibers at the second end of the capillary body being aligned with the electrically conductive filaments of the flat-shaped fluid-permeable heating element, and wherein the liquid storage portion and the heater assembly are provided in the cartridge, the cartridge being removably mounted to the main unit.

2. The aerosol-generating system according to claim 1, further comprising an elongated body, wherein the flat-shaped fluid-permeable heating element is arranged transverse to the elongated body.

3. The aerosol-generating system according to claim 1, further comprising electric circuitry connected to the heater assembly and to an electrical power source, and being configured to monitor an electrical resistance of the heater assembly or of one or more filaments of the heater assembly, and to control a supply of power from the electrical power source to the heater assembly dependent on the electrical resistance of the heater assembly or of the one or more filaments.

4. The aerosol-generating system according to claim 1, wherein the system is an electrically operated smoking system.

* * * * *